United States Patent [19]

Terral

[11] Patent Number: 4,480,687

[45] Date of Patent: Nov. 6, 1984

[54] SIDE POCKET MANDREL SYSTEM FOR DUAL CHEMICAL INJECTION

[75] Inventor: Ben D. Terral, Houston, Tex.

[73] Assignee: Schlumberger Technology Corporation, New York, N.Y.

[21] Appl. No.: 468,929

[22] Filed: Feb. 23, 1983

[51] Int. Cl.[3] ..... E21B 37/06

[52] U.S. Cl. ..... 166/117.5; 166/244 C; 166/321

[58] Field of Search ..... 166/117.5, 321, 242, 166/311, 312, 72, 244 C, 322

[56] References Cited

U.S. PATENT DOCUMENTS

| | | | |
|---|---|---|---|
| 4,031,955 | 6/1977 | Ledet | 166/117.5 X |
| 4,239,082 | 12/1980 | Terral | 166/117.5 |
| 4,371,038 | 2/1983 | Abernathy et al. | 166/244 C X |

*Primary Examiner*—Stephen J. Novosad
*Assistant Examiner*—Thuy M. Bui

[57] ABSTRACT

In accordance with an illustrative embodiment of the present invention, a system for separate injection of a plurality of chemicals into the production string of a well at substantially the same depth or level includes upper and lower side pocket mandrels having pressure responsive control valves seated in their respective side pockets, a first chemical supply conduit extending from the top of the well to the side pocket of said upper mandrel and then continuing to and through said lower mandrel to an injection point adjacent the lower end of the side pocket in said lower mandrel, and a second chemical supply conduit leading from the top of the well to and through said upper mandrel and then to the side pocket of said lower mandrel, whereby chemicals supplied under pressure to said conduits can flow past said control valves and be injected into the tubing in a manner to treat substantially the entire length thereof above said injection point.

12 Claims, 6 Drawing Figures

SIDE POCKET MANDREL SYSTEM FOR DUAL CHEMICAL INJECTION

FIELD OF THE INVENTION

This invention relates to chemical injection systems for use in producing oil wells, and specifically to a new and improved combination of side pocket mandrels and injection control lines for applying chemical treatment to the entire length of the production tubing that is located above the lowermost point of chemical injection.

BACKGROUND OF THE INVENTION

It is fairly common practice to inject various chemicals (such as corrosion inhibitors, scale removers, and the like) into the production tubing of an oil well. Usually, such well treatment is carried out by filling the well annulus with chemicals and then injecting the chemical under pressure into the tubing past a control valve located in a side pocket mandrel that is connected in the tubing downhole. It will be recognized that this procedure is not practical for injecting more than one chemical since the chemicals could be intermixed in an undesirable manner. Other systems of upper and lower spaced mandrels have been tried, including a first supply line for injecting one chemical into the tubing at the level of the upper mandrel, and a second supply line for injecting another chemical into the tubing at the level of the lower mandrel. However, these systems have the principal disadvantage that the length of tubing that is connected between the two mandrels is not treated by the chemical that is injected through the upper mandrel because the flowing production fluids carry this chemical upwardly and away from such length of tubing.

The general object of the present invention is to provide a new and improved chemical injection system for treating the entire length of the production tubing located above the lower one of a plurality of injection mandrels with a plurality of chemicals.

SUMMARY OF THE INVENTION

This and other objects are attained in accordance with the concepts of the present invention through the provision of an injection system comprising upper and lower mandrels, preferably of the side pocket type, that are connected in the production tubing of an oil well and which are separated by an intermediate length of tubing. Each of the mandrels has a normally closed pressure responsive control valve seated therein, and a first chemical supply conduit that leads from the top of the well to the lower mandrel enables injection of a first chemical under pressure through a control valve and into the bore of the tubing at a point adjacent the lower mandrel. A second chemical supply conduit that leads from the top of the well to the upper mandrel enables a second chemical to be supplied under pressure via another control valve to a third chemical supply conduit that leads from the upper mandrel to the lower mandrel so that said second chemical can be injected into the bore of the tubing at a level adjacent the level of injection of said first chemical. In this manner, substantially the entire length of the production tubing above the lowermost mandrel is subjected to treatment by both chemicals in a highly desirable manner.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
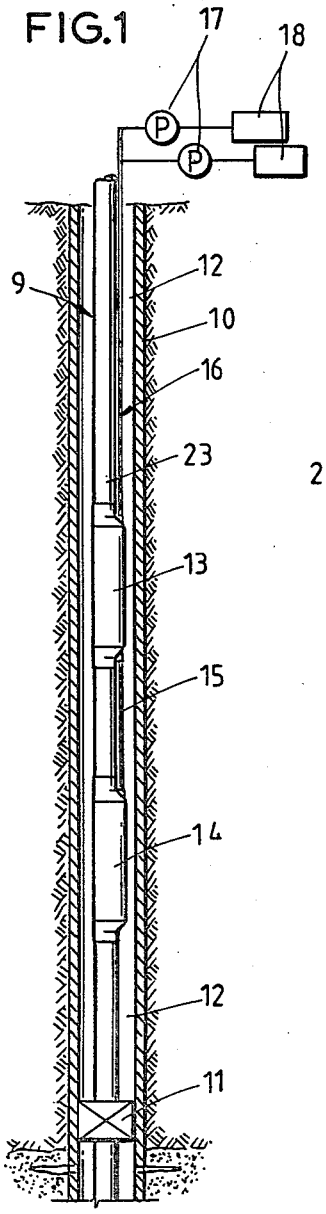
FIG. 1 is a schematic view of a producing well installation that embodies the present invention.

Referring initially to FIG. 1, there is shown schematically a well installation including a production string of tubing 9 that extends down into a well casing 10. A packer 11 of typical construction provides an anchored packoff above the production interval, and serves to isolate such interval from the well annulus 12 thereabove. The top of the production tubing is suspended by a hanger or the like in a well head (not shown) having a master valve and wing valve through which production fluids are conveyed to a gathering facility or sales line.

Upper and lower side pocket mandrels 13 and 14 are connected as integral parts of the production string and are separated by an intermediate length of tubing 15. Chemical supply lines or control conduits indicated generally at 16 extend from the top of the well to the mandrels as will become more fully apparent herebelow. The upper ends of the lines extend through suitable fittings in the wellhead and are coupled by suitable lines to pumps 17 and containers 18 by means of which various chemicals such as corrosive inhibitors and scale removers can be supplied under pressure to the respective control lines.

Figure 2:
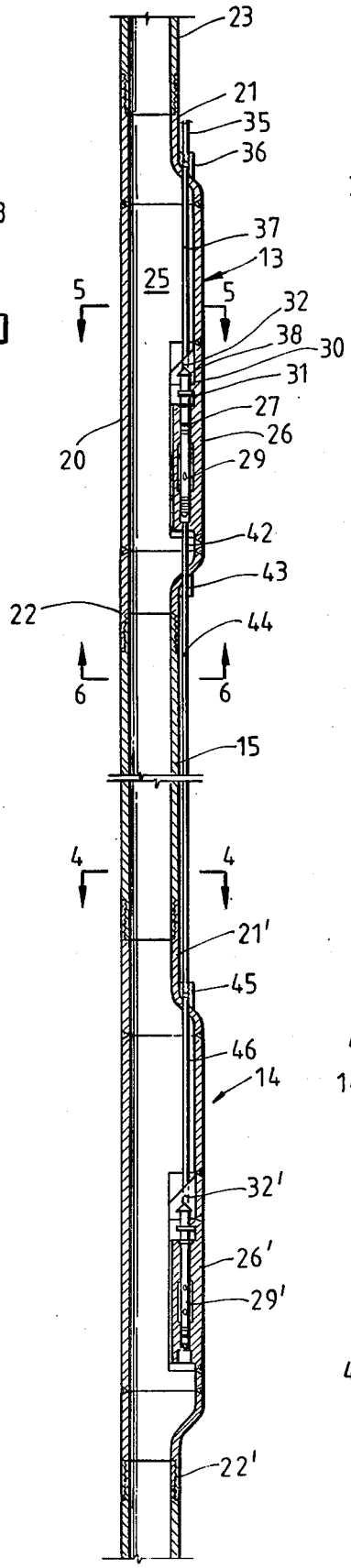
FIGS. 2 and 3 are respective side section and rear elevation views of the downhole portion of the present invention.
Figure 3:
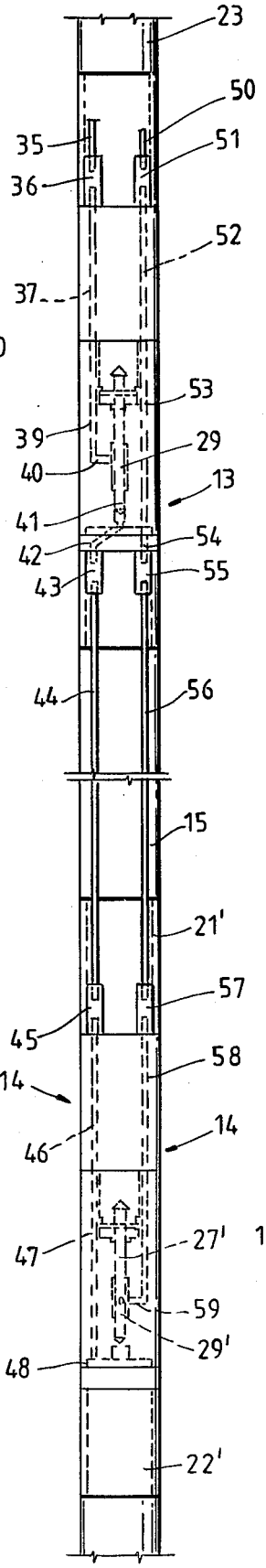
Figure 4:
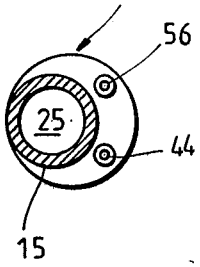
FIGS. 4–6 are respective cross-sectional views taken along lines 4—4, 5—5 and 6—6 of FIG. 2.
Figure 5:
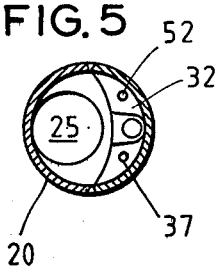
Figure 6:
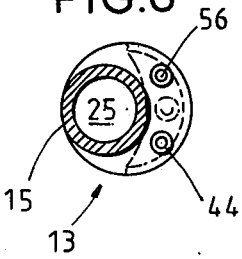

Turning now to FIGS. 2 and 3 for a description of further details of the apparatus of the present invention, the upper mandrel 13 includes a central body 20 formed of a section of pipe that typically has an oval cross section, the body being welded at its ends to coupling members 21 and 22 having internal threads for connecting the mandrel to the lower end of the upper tubing string 23 and to the upper end of the intermediate length of tubing 15. An orienting sleeve (not shown) may be fixed within the bore of the upper coupling member 21 for rotationally orienting a kickover tool so that its arm is properly aligned to seat or remove a control valve that is releasably coupled thereto. The mandrel 13 has an open bore 25 that is axially aligned with the bore of the well tubing 23, and a side pocket body 26 that provides an open-topped pocket 27 which is laterally offset from such open bore and which is arranged to receive a flow control device such as a chemical injection valve 29 of typical construction. Such valves include a valve element that is urged toward a seat by a spring or a dome gas pressure charge, and which is moved from a normally closed position to an open position in response to applied pressure that acts on a piston or a diaphragm. The control valve is releasably retained in the side pocket by a latch 30 that engages a shoulder 31. A deflector guide 32 is welded to the body 26 above the shoulder 31 to guide the control valve 29 into the pocket 27 during installation, and to deflect into the open bore 25 other instrumentalities or devices that may be used in connection with other well service operations so that such devices do not hang up on the side pocket.

A first control line 35 for supplying a first chemical extends downwardly through the well annulus 12 alongside the tubing 23 and is coupled by a fitting 36 to an interior short line 37 having its lower end welded or otherwise secured to the deflector guide 32 at the upper end of a vertically extending flow channel 38 formed thereon. Such channel is communicated with a lower flow channel 39 in the side pocket body 26 having a transversely extending portion 40 that communicates with the pocket 27 between the respective locations of the upper and lower packing elements on the flow control valve 29. A bore 41 at the lower end of the pocket 27 is connected with another short line 42 that extends to a fitting 43 to which an extension 44 of the control line is connected. The extension 44 extends down alongside the intermediate length of tubing 15 and is connected by a pressure fitting 45 to another interior line 46 in the upper end section of the body of the lower mandrel 14. The lower end of the line 46 is coupled in a fluid-tight manner to the upper end of a longitudinally extending bore 47 that extends through the deflector guide 32' and the side pocket body 26' of the lower mandrel to an exit point 48 at the lower end of the body 26'.

A second control line 50 that extends downwardly alongside the tubing section 23 is provided for supplying a second chemical to be injected in order to treat the production string. The lower end of the line 50 is connected by a fitting 51 to another interior line 52 which is connected in a leak-proof manner to the upper end of a vertical bore 53 that extends downwardly through the mandrel as shown in phantom lines in FIG. 3. The lower end of the bore 53 is connected by a short line 54 and a fitting 55 to a second extension line 56 that also extends alongside the length of tubing 15 to a fitting 57 on the upper end of the lower mandrel 14. In a manner similar to the manner in which the upper mandrel 13 is constructed, the fitting 57 is coupled to another inner short line 58 that is fluidly connected to a flow channel which leads to a transverse port 59 which opens into the lower pocket 27' between the upper and lower polish bores thereof. Of course the lower end of the pocket 27' is communicated with the interior bore 25 of the mandrel 14 at the same level as the exit point 48 for the first chemical.

Since the mandrels 13 and 14 are somewhat similar although not identical in construction similar reference numerals have been used to identify like parts where possible.

OPERATION

In operation, a first chemical such as a scale remover is injected under pressure via the control line 35 and causes the control valve 29 to open. The chemical then passes through the lines 42, 44, 46 and 47 and the exit port 48 out into the bore of the production string so as to treat the entire length of the production string above the level of the exit port 48. Either at the same time or after such chemical treatment has been completed, a second chemical such as a corrosion inhibitor is supplied under pressure to the other control line 50. This chemical passes via the lines and flow channels 52, 54, 56, 58, and 59 into the pocket 27' adjacent the lower control valve 29', so that applied pressure will cause the opening of the valve, with consequent injections of chemicals into the bore of the tubing at the same level as the exit point 48. Thus the entire length of the production string above the lower mandrel 14 also is treated with such chemical.

It now will be recognized that a new and improved chemical injection system having dual control lines has been provided which enables the entire production string located above the lower one of a plurality of injection mandrels to be treated with a plurality of treating chemicals. Certain changes or modifications may be made in the disclosed embodiment without departing from the inventive concepts involved. For example, although vertically extending bores have been described as a fluid channel for conducting chemicals through the deflector guides and side pocket bodies of the mandrels, it would be within the scope of the present invention to provide enlarged bores and to run interior lines through such bores. It is the aim of the appended claims to cover all such changes and modifications that fall within the true spirit and scope of the present invention.

What is claimed is:

1. Apparatus for use in injecting chemicals or the like into the production tubing string of a well comprising: upper and lower mandrels connected in the tubing string in vertically spaced relationship, each of said mandrels having a normally closed pressure responsive control valve seated therein for controlling the flow of a chemical from externally of said mandrels; a first chemical flow path extending substantially through said upper mandrel and said lower mandrel and including an injection port in communication with the bore of said tubing string at a location adjacent the lower end of said lower mandrel, said control valve seated in said upper mandrel being arranged to control the flow of a first chemical through said first flow path; and a second chemical flow path extending substantially through said upper mandrel and said lower mandrel and including an injection port in communication with the bore of said tubing string at a location adjacent the lower end of said lower mandrel, said control valve seated in said lower mandrel being arranged to control the flow of a second chemical through said second flow path.

2. The apparatus of claim 1 wherein said mandrels are connected together by a length of tubing, and wherein said first and second chemical flow paths are each defined in part by a fluid conducting line extending externally of said tubing.

3. The apparatus of claim 1 wherein said upper mandrel includes an elongated valve seating means having vertically spaced polish bores, that portion of said first chemical flow path that extends substantially through said upper mandrel including a laterally extending port that intersects said seating means between said polish bores.

4. The apparatus of claim 1 wherein said lower mandrel includes an elongated valve seating means having vertically spaced polish bores, that portion of said second chemical flow path that extends substantially through said lower mandrel including a laterally extending port that intersects said seating means between said polish bores.

5. The apparatus of claim 3 wherein said lower mandrel includes an elongated valve seating means having vertically spaced polish bores, that portion of said second chemical flow path that extends substantially through said lower mandrel including a laterally extending port that intersects said seating means between said polish bores.

6. Apparatus for use in injecting chemicals and the like into the production tubing of a well comprising: upper and lower side pocket mandrels connected in said tubing in vertically spaced relationship, each of said mandrels having a normally closed pressure responsive control valve seated in the side pocket thereof; a first chemical supply conduit leading from the top of the well to the side pocket of the lower one of said mandrels so that pressure applied thereto can cause the opening of said control valve in said lower mandrel and injection of chemicals into the bore of said tubing at a point adjacent said lower mandrel; a second chemical supply conduit leading from the top of the well to the side pocket of said upper mandrel so that pressure applied thereto can cause the opening of said control valve in said upper mandrel; and a third chemical supply conduit leading from said upper mandrel to said lower mandrel for injecting chemicals into the bore of said tubing at a location adjacent the point of injection of chemicals from said first conduit.

7. The apparatus of claim 6 wherein said mandrels are connected together by a length of tubing, and wherein said first and second chemical supply conduits are each defined in part by a fluid conducting line extending externally of said tubing.

8. The apparatus of claim 6 wherein the side pocket of said upper mandrel has vertically spaced polish bores, a portion of said first chemical supply conduit including a laterally extending port that intersects the bore of said side pocket between said polish bores.

9. The apparatus of claim 8 wherein the side pocket of said lower mandrel has vertically spaced polish bores, a portion of said second chemical supply conduit including a laterally extending port that intersects the bore of the side pocket therein between said polish bores.

10. A side pocket mandrel comprising: a tubular body having an open bore and an open-topped pocket laterally offset from said open bore; means on each end portion of said body for connecting said mandrel in a tubing string; said pocket having vertically spaced annular seal surfaces and having open communication with said open bore at the top and bottom ends thereof; first flow channel means for conducting a chemical or the like from a location externally of the upper end of said mandrel to a location in communication with the bore of said pocket between said seal surfaces; second flow channel means for communicating said lower end of said pocket with a location externally of the lower end of said mandrel; and third flow channel means for conducting another chemical or the like from a location externally of the upper end of said mandrel to a location externally of the lower end thereof.

11. A side pocket mandrel comprising: a tubular body having an open bore and an open-topped pocket laterally offset from said open bore; means on each end portion of said body for connecting said mandrel in a tubing string; said pocket having vertically spaced annular seal surfaces and having open communication with said open bore at the top and bottom ends thereof; first flow channel means for conducting a chemical or the like from a location externally of the upper end of said mandrel to a location in communication with the bore of said side pocket between said seal surfaces; and second flow channel means for conducting another chemical or the like from a location externally of the upper end of said mandrel to a location in communication with said bore of said mandrel at substantially the same level as the lower open end of said pocket.

12. Apparatus for use in injecting chemicals or the like into the bore of the production tubing string of a well, comprising:

a first mandrel;

a second mandrel;

an intermediate length of tubing connecting the first and second mandrels in vertically spaced relationship as part of the tubing string;

a first conduit;

a first normally closed pressure-responsive control valve positioned within the first mandrel for controlling the flow of a first quantity of chemical from externally of the tubing through the first conduit to a first point of injection into the bore of the tubing;

a second conduit; and a second normally closed pressure-responsive control valve positioned within the second mandrel for controlling the flow of a second quantity of chemical from externally of the tubing through the second conduit to a second point of injection into the bore of the tubing; the second point of injection being at a level which is adjacent to the level of the first point of injection, whereby the length of the bore of the tubing treated by the first quantity of chemical will be substantially the same as the length of the bore of the tubing treated by the second quantity of chemical.

* * * * *